US006343133B1

(12) United States Patent
Adamson

(10) Patent No.: US 6,343,133 B1
(45) Date of Patent: Jan. 29, 2002

(54) AXIALLY PROPAGATING MID AND HIGH FREQUENCY LOUDSPEAKER SYSTEMS

(76) Inventor: Alan Brock Adamson, 2354 Passmore Ave., Scarborough, Ontario (CA), M1X 1P8

( * ) Notice: Subject to any disclaimer, the term of this patent is extended or adjusted under 35 U.S.C. 154(b) by 0 days.

(21) Appl. No.: 09/359,766

(22) Filed: Jul. 22, 1999

(51) Int. Cl.[7] ..... H04R 25/00

(52) U.S. Cl. ..... 381/340; 381/351; 381/343; 381/337; 181/152

(58) Field of Search ..... 181/144, 148, 181/152, 159, 160, 199; 381/335, 340, 343, 351, 386, 341–342, 182, 186

(56) References Cited

U.S. PATENT DOCUMENTS

| | | | | | |
|---|---|---|---|---|---|
| 3,138,220 | A | | 6/1964 | Glindmeyer | |
| 4,014,597 | A | | 3/1977 | Griffin, Jr. | |
| 4,040,503 | A | * | 8/1977 | Hino et al. | 181/152 |
| 4,805,730 | A | | 2/1989 | O'Neill et al. | |
| 4,811,403 | A | | 3/1989 | Henricksen et al. | |
| 4,815,559 | A | | 3/1989 | Shirley | |
| 4,836,327 | A | * | 6/1989 | Andrews et al. | 181/152 |
| 4,862,508 | A | | 8/1989 | Lemon | |
| 5,000,286 | A | | 3/1991 | Crawford et al. | |
| 5,109,423 | A | * | 4/1992 | Jacobson et al. | 181/152 |
| 5,163,167 | A | | 11/1992 | Heil | |
| 5,526,456 | A | | 6/1996 | Heinz | |
| 5,552,569 | A | | 9/1996 | Sapkowski | |
| 5,900,593 | A | * | 5/1999 | Adamson | 181/152 |
| 5,991,421 | A | * | 11/1999 | Faraone | 381/338 |
| 6,028,947 | A | * | 2/2000 | Faraone et al. | 381/340 |
| 6,095,279 | A | * | 8/2000 | Adamson | 181/152 |

* cited by examiner

*Primary Examiner*—Sinh Tran
*Assistant Examiner*—P. Dabney
(74) *Attorney, Agent, or Firm*—Dowell & Dowell, P.C.

(57) ABSTRACT

A loudspeaker system of improved clarity, coherence and uniformity of energy distribution containing mid frequency sound chambers with an annular input and approximately rectangular output for use in multi-way co-axial horn loaded line array systems. The sound chambers propagate the annular mid frequency sound wave co-axially with a high frequency sound wave, gradually changing the cross section of the mid frequency wavefront resulting in co-linear acoustic mid and high frequency wavefronts from multiple devices which range from the shape of a flat ribbon to that of a curved ribbon. The sound chambers may be arrayed contiguously and placed at the entrance of a suitable waveguide to form a wide band width acoustic line source of extended length and controlled beamwidth.

10 Claims, 7 Drawing Sheets

28
26
35
36
33
17
18
33'
33''
65

AXIALLY PROPAGATING MID AND HIGH FREQUENCY LOUDSPEAKER SYSTEMS

BACKGROUND OF THE INVENTION

1. Field of the Invention

The present invention is generally directed to loudspeaker systems and more particularly to loudspeaker systems which use sound chambers which progressively propagate entering annular mid frequency sound waves concentrically about high frequency sound waves to an output wherein the mid frequency sound waves are substantially parallel on opposite sides of the high frequency sound waves.

2. Brief Description of the Related Art

Most loudspeaker systems for commercial or professional applications require more than one transducer. There are two common reasons for this that stem from the limits of transducer technology: limited bandwidth; and/or limited sound power output of individual transducers.

The limited bandwidth of transducers, when compared with the wide bandwidth of the human ear dictates the need for multi-way loudspeaker systems. The wavelengths of sound audible to us range from nearly sixty feet to less than three quarters of an inch in length. No single transducer can reproduce this range of frequencies with acceptable levels of both distortion and efficiency.

The limited sound power capacity of a single multi-way loudspeaker unit when compared to the sound power and distribution required for large venues, dictates the need for multi-unit loudspeaker groups or arrays. This is the case in nearly all commercial use or professional loudspeaker systems. For the purposes of this discussion, multiple units of multi-way loudspeakers will be considered.

Clarity, referred to also as intelligibility and speech intelligibility, is affected by the degree to which the loudspeaker reconstructs the temporal and spectral response of the reproduced wavefront. Interference in the perception of that wavefront can be caused by environmental reflections of sound waves bearing the same spectral information which arrive near in time to the beginning of the wavefront.

Coherence of a wavefront refers to the degree to which the loudspeaker reconstructs the temporal response of the reproduced wavefront.

Uniformity of distribution refers to the similarity in the temporal and spectral nature of the reproduced sound when considered spatially.

Correction of the sound spectrum through equalization is easily achieved with signal processing equipment. Correction of the temporal aspects of sound referred to as impulse response equalization is considerably more complex. Correction of the spatial distribution of sound energy, after the sound has exited the loudspeaker system is not possible.

To fully understand all aspects concerning clarity in large loudspeaker systems, it is necessary to consider issues beyond those limited to the temporal and spectral performance of individual transducers and their related enclosures or waveguides. Wavefront coherence and uniformity must be considered concerning several aspects of the multi-way structure and the multi-unit array. In the multi-way loudspeaker the additional issues are twofold; the reconstruction of complex waveforms from two or more transducers not physically occupying the same location that reproduce different parts of the spectrum; and the temporal interference that occurs in the region of spectral overlap between transducers. In the multi-unit array a further consideration is added: the temporal interference between multiple transducers working together to reproduce the same part of the spectrum.

Complete and uniform energy summation occurs when two or more simple cone loudspeakers produce sound waves of the same frequency which propagate into the same space, where the wavelength propagated is approximately equal to or greater than the spacing of the loudspeakers. In cases such as this the devices are said to be mutually coupled; multiple devices work nearly as a single device.

Complex patterns of summation result in reduced spatial uniformity and lost efficiency when two or more transducers produce sound waves of the same frequency which propagate into the same space, where the wavelength propagated is smaller than the spacing of the transducers. These patterns are not easily integrated in systems and most often, the result is reduced coherence of the wavefront and therefore reduced sound quality.

It is evident that a useful approach to the problem of summation is to physically limit or eliminate the negative interaction between adjacent transducers through the design of wavefront modifying or directivity controlling mechanical geometry through which the sound waves are propagated. The mechanical control of such interactions are therefore of great interest in the development of better loudspeaker arrays.

From the ideal loudspeaker system, sound would appear to the listener as though it came from a point source floating in space. This goal is approachable in a single multi-way loudspeaker, but impossible in a large sound system. Nevertheless, audio engineers have sought over the years to come as close to the goal as possible through a number of interesting innovations.

In small systems, it can be said generally that for best coherency, the physical spacing between transducers of differing frequency ranges should be kept as small as possible. Whereas in large systems, more attention should be paid to the physical relationship between transducers operating in the same frequency range due to the overall size of the array.

The evolution of the co-axial loudspeaker has resulted in improved coherency in two-way systems. A typical variation is a two-way device consisting of a high frequency compression driver mounted on the back plate of a woofer magnet, so configured to allow the sound from the high frequency driver to pass through the woofer and emerge at the center of the cone of the woofer. The passageway through the low frequency magnet combined with the woofer cone, or other small horn device, serve to guide the high frequency energy. The addition of time compensation in the signal path to correct for the physical displacement of the two sound sources produces something very close to the ideal. In this described configuration a direct radiator is combined with a horn loaded driver.

However, the directivity cannot be controlled to the extent that might be desired at all frequencies in such a loudspeaker. Furthermore, a substantial part of the benefit of point source approximation is lost when multiple co-axial speakers are configured in an array spaced on the centers of the woofer. The larger size of the woofer may result in the space between high frequency drivers increasing beyond the dimension allowed by the smaller high frequency drivers, thus aggravating the interference problem between the high frequency components. It is evident that the co-axial driver can improve coherence in a small system, but where large multiples are deployed, no significant gain is likely to occur.

The recently introduced co-entrant horn disclosed in U.S. Pat. No. 5,526,456 to Heinz is a two way, mid frequency and high frequency horn loaded variation on the co-axial loudspeaker. In this variation, the high frequency compression driver is mounted on the back plate of a mid frequency compression driver magnet, so configured to allow the sound from the high frequency driver to pass through the mid frequency device and emerge through the center of the diaphragm of the mid frequency driver. The energy from the mid frequency diaphragm enters the throat of the horn through an annular slot adjacent to the high frequency opening. With suitable time compensation to align the acoustic output of the two devices in the time domain, the result is similar to the co-axial loudspeaker, but with the added advantages of increased mid frequency efficiency and control of mid frequency directivity through the horn loading of that band of energy. However, the discontinuity in the high frequency throat caused by the mid frequency entrance to the throat of the waveguide is quite close to the high frequency driver diaphragm. If the discontinuity is within one quarter wavelength of a given frequency, energy reflected back to the diaphragm will arrive at the half wave interval fully out of phase and cause disruptions in response.

The improvement in the relationship between the two elements within the device, is offset by increased spacing between the high frequency drivers in an array caused by the size of the mid frequency horn. In large arrays therefore, no improvement in high frequency coherence or uniformity of distribution is likely to occur.

Coherency in loudspeaker arrays is a far more complex problem than that of coherency in the single multi-way loudspeaker. Firstly because of the potential size and number of elements to be found in arrays and secondly because of the more difficult acoustic environment and listener configuration in which arrays are typically applied.

Large numbers of transducers are required in large and small auditoria, compounding the problems of spatial distribution and coherence. Where the system design specifies such loudspeakers to be widely distributed throughout the environment, the state of the art with respect to loudspeakers seems sufficient.

Wide distribution throughout the listening space is generally not acceptable where a large public sound system is oriented to music or speech performance. The acoustical focus of the audience, is in most cases, the stage. It is then a primary requirement that an array of multiple speaker enclosures will be placed in close proximity with one another in front of and facing the audience in order to complement that focus. Generally there are at least two arrays of loudspeakers flanking the stage. It is equally inevitable that the interactions between loudspeakers within each array will play a significant role in the outcome.

The consideration of wavelength is preeminent in the science of sound: all sound phenomena are at least in some aspect wavelength dependent. Design considerations with respect to loudspeaker interaction in large arrays are in fact dominated by consideration of wavelength.

First, the wavelength of any frequency under consideration in the array will determine in which frequency range the individual transducers are coupled with one another and in what range they are interfering. Secondly, the directivity of any device is wavelength dependant; the directivity will determine the degree of angular overlap of adjacent wavefronts and therefore the degree of potential acoustical interference.

Wavelength variation of three orders of magnitude over the audio spectrum assures us that no one transducer can possess the same radiation characteristics over the whole audio spectrum. In fact, even when the spectrum is divided into three separate frequency ranges, most transducers operating even within these reduced bandwidths demonstrate a continuous change in the radiation pattern of their acoustic energy with changing frequency.

While a phenomenon can be useful in one frequency range, it may be detrimental in another. One effect, destructive interference, is generally just that. However, this phenomenon can also be used to limit unwanted energy beyond the edge of an area of desired coverage, such as with a di-pole radiator.

Another effect, mutual coupling, while generally regarded as a positive with respect to efficiency and wavefront coherence, can also be a hindrance when beam width narrows excessively. Coupling between drivers, combined with electrically induced phase shift is also responsible for the undesirable effect of beam tilting through the crossover region between two drivers. Mutual coupling occurs when drivers are placed within approximately one wavelength of one another. See Olson, Elements of Acoustical Engineering, 1944 Van Nostrand and Co.

In a line array (Olson et al) in its simplest form, a row of closely spaced direct radiators, is dependant on mutual coupling of one driver to the next. Historically, line arrays have consisted of multiple small direct radiating transducers arranged in a vertical row. Typically the drivers are chosen to be sufficiently small to allow mutual coupling to the highest frequency of concern. For example four inch diameter drivers permit coupling to above 3 Khz, which is sufficient to allow good speech intelligibility. This approach yields a system with a controlled vertical coverage and correspondingly wide horizontal coverage.

Another variation on the line array is a vertical column of high frequency compression drivers mounted on horns with narrow vertical beam width. However, the mutual coupling is limited to a small portion of the lower range of the high frequency transducer.

The ribbon tweeter can be considered a line array of nearly infinite elements, with all the attendant benefits. However, limits in sensitivity and power handling capacity have not permitted the ribbon tweeter to replace the preeminent position of the high frequency compression driver in systems for large spaces.

Spatial distribution of energy within the listening environment has increasingly become the focus of efforts by practitioners of the audio arts. The result of this effort is a number of novel innovations.

Very old established principles which define the line source of Olson et al. are now being combined with significant new trends including new geometry for the purpose of modifying high frequency wavefronts. See for example U.S. Pat. Nos. 5,163,167 to Heil and 5,900,593 to Adamson.

In the interests of improved coherence, spatial distribution and frequency response, a number of high power, high fidelity line array variations have recently been introduced. These multi-way systems all approach the different frequency bands with different technology. While most of these new concepts rely on prior art in the direct radiator portion of the array, several new concepts have emerged in the effort to create line arrays to the highest discernable frequency.

The prior art patents to Heil and Adamson reveal high frequency acoustic sound chambers (that are sometimes referred to as waveguides) capable of wavefront transformation to the highest audio frequencies, for use with compression drivers and waveguides. The output of such devices provide an essentially continuous ribbon of coherent high frequency sound. When placed end to end, even in large arrays, high frequency coherency is maintained. This high frequency solution is seen in curved horizontal and vertical arrays in Adamson and flat vertical arrays in Heil.

Other high frequency sections of new line arrays consist of a previously described simple vertical row of conventional high frequency horn and driver units.

In the mid frequency range significant unresolved problems are apparent. Two general categories of solution are now in use: horn loaded and direct radiator systems. The benefits and limitations of these solutions must be considered with respect to vertical and horizontal arrays.

When direct radiators are used in a mid frequency vertical array, it is not regarded as a suitable solution to place a single mid frequency line array beside a high frequency array. The lack of horizontal symmetry will result in undesirable variations in frequency response across a horizontal section of the array. A more likely solution is to place two vertical line arrays spaced equidistant from a central high frequency line array.

However, due to upper frequency requirements of the mid frequency direct radiators, a maximum size limitation is imposed. This size limitation is incompatible with the demand for substantial acoustic power in the mid band. In such applications, the direct radiating mid frequency devices cannot match the acoustic output of the more efficient high frequency combination of waveguide and compression driver.

Furthermore, the horizontal spacing between the two vertical line arrays of mid frequency devices introduces a special set of limits due to the behavior of the two sound sources. When the two line arrays are spaced at the half wavelength of a given frequency, the energy from one line array arrives at the other 180 degrees out of phase and a cancellation of energy occurs. At higher frequencies the wavefront is divided into a number of narrow lobes due to variable summation between the two sources. While some control of directivity is achieved the gain is offset by losses due to the cancellations, which further reduce the efficiency of the direct radiators.

Much higher efficiencies can be achieved with horn loaded mid frequency, but the typical horn loaded horizontal or vertical arrays results in significant increases in driver to driver spacing. In such systems the mid section behaves as a coupled line array only in the lower half of the spectrum handled by the transducer. Above that frequency the array performs somewhat like a row of point source radiators with all the associated patterns of interference.

When the mid frequency is horn loaded in two columns placed symmetrically about the high frequency array, off axis problems arise due to the differing acoustic centers of the midrange and high frequency arrays. These problems arise due to the physical size of such devices.

In the case of three-way systems where a low frequency section is employed, there are few problems with conventional horizontal and vertical line arrays since these long wavelengths permit mutual coupling with conventional 12", 15" and 18" woofers in the appropriate frequency ranges. Acoustic efficiencies and wavefront shape present few problems.

SUMMARY OF THE INVENTION

The present invention is comprised of a plurality of loudspeaker enclosures arranged in a horizontal or vertical array, where each enclosure must contain at least one high frequency compression driver and at least one inner sound chamber similar to that disclosed in U.S. Pat. No. 5,163,167 to Heil or as disclosed in U.S. Pat. No. 5,900,593 to Adamson or other high frequency throat piece as required to connect a high frequency driver to a waveguide, and at least one mid frequency driver and at least one outer mid frequency sound chamber so shaped to substantially enclose the inner high frequency sound chamber within the mid frequency sound chamber, whereby the inner surface of the outer sound chamber and the outer surface of the inner sound chamber form an acoustic passageway whose input orifice is annular and whose output orifices approximates two parallel slots of approximately uniform width which may be curved or flat. The enclosure may contain an extension of the high frequency sound chamber and the mid frequency sound chamber to further direct the sound waves after the exit of the sound waves from the high frequency and mid frequency sound chambers.

Where the loudspeaker enclosures are arranged in a vertical array the vertical cross section of the enclosure may be trapezoidal or rectangular and where the loudspeaker enclosures are arranged in a horizontal array the horizontal cross section of the enclosure may be trapezoidal or rectangular.

In the present invention there are no differences in principle or geometry between a horizontal array and a vertical array. The horizontal array is a simple 90 degree transformation of the vertical array and vice versa. Depending on the desired application, various embodiments may be constructed and oriented in any desired angle to suit the desired application.

In the typical embodiment the high frequency driver is fixed to the back plate of the magnet assembly of the mid frequency driver and is so placed to be concentric with and axially aligned to the mid frequency driver and the high frequency sound chamber is aligned axially and affixed concentrically to the front side of the mid frequency magnetic assembly which is so constructed to allow high frequency sound to pass through the magnetic structure of the mid frequency driver and to enter into the entrance of the high frequency sound chamber.

The mid frequency sound chamber is fixed to the front side of the mid frequency driver and is so placed to be concentric with and axially aligned to the mid frequency driver and is so shaped to form at least one passageway which is defined by the outer surfaces of the outer walls of the high frequency sound chamber and the inner surfaces of the inner walls of the mid frequency sound chamber with the at least one passageway extending from the annular input orifice to the rectangular output orifice of the mid frequency sound chamber.

The at least one passageway may be divided into at least two passageways which extend the full length of the high frequency sound chamber extending from the annular input orifice to the rectangular output orifice so configured to divide the annular input orifice into at least two arc segments and to shape the output orifices as two equal and parallel rectangular slots, defined by the outer surface of the high frequency sound chamber and the inner surface of the mid frequency sound chamber. A further aspect of the present invention is that the outer surface of the high frequency sound chamber and the inner surface of the mid frequency sound chamber provide a smooth and continuous transition in the cross sectional shape of the passageways to permit a gradual transformation of the shape of the mid frequency wavefront from an arc segment at the entrance to rectangular at the exit.

In the preferred embodiment, the outer surface of the inner high frequency sound chamber is modified to assist in the smooth transition from the annular input orifice to the rectangular output orifice. To facilitate this, a wedge shaped body of material is added to the sides of the high frequency sound chamber so shaped that the thin edge of the wedge divides the annular input orifice into two arc segments. The wedge shaped body of material expands in width as the distance from the input orifice increases thus changing the shape of the passageway according to the width of the wedge.

Furthermore in some embodiments the wedge shaped body is flattened and tapered in thickness and so shaped to conform to the inner surface of the mid frequency sound chamber to provide mating surfaces whereby the outer surface of the high frequency sound chamber is fixed to the inner surface of the mid frequency sound chamber.

In the preferred embodiment the outer surface of the inner high frequency sound chamber is extended at the output orifice to provide an additional high frequency acoustic load and to further guide the high frequency sound wave in a beam width of the desired angle. The outer surface of the inner sound chamber is further modified to provide a smooth passageway for the mid frequency sound wave propagated in the outer sound chamber as it passes out from the output orifice of the outer sound chamber.

A further aspect of the present embodiment is that the dimension of the outermost width of the dual rectangular output orifices of the mid frequency sound chamber is limited to less than one wavelength of the highest frequency that is expected to be propagated solely by the mid frequency sound chamber. The mid frequency sound chamber is therefore capable of propagating a wavefront into the cabinet waveguide to which it is connected to the highest frequency of concern without undesired narrowing of the beam width. Because of the close proximity of the two mid frequency exits, the mid frequency energy appears acoustically at the center of the waveguide. Because the exit of the high frequency sound chamber is located in the center of the two mid frequency sound chamber exits and thus at the center of the waveguide, both the mid and high frequency sound appear to originate acoustically from the same location. This geometry can be extended in a line, vertically or horizontally, with as many devices as required. An array of such sound chambers can be considered therefore, to be co-linear.

In the present embodiment the co-linear exit of the mid frequency and high frequency sound chambers is preferably joined to the entrance of the waveguide constructed according to the teachings of Adamson, U.S. Pat. No. 5,900,593 or according to the practice of Heil, U.S. Pat. No. 5,163,167.

In some embodiments, the enclosure may contain one or more low frequency loudspeakers, which may be configured to radiate sound in any manner which is deemed acceptable to provide the required low frequency sound power to complement the mid frequency and high frequency drivers.

Another distinct aspect of the preferred embodiment is that acoustical interference is created at the exits of the mid frequency sound chamber and the high frequency sound chamber due to discontinuities in reflected impedance and acoustic cancellations. These negative effects occur where the sound waves merge at the entrance to the waveguide, and are limited to a controlled bandwidth.

The interference is caused because the mid frequency wavefront encounters a discontinuity in acoustical resistance due to the space occupied by the high frequency sound chamber exit. Likewise, the high frequency wavefront encounters a discontinuity in acoustical resistance due to the space which is occupied by the exit of the mid frequency sound chamber. Both these discontinuities cause acoustical reflections and cancellations which result in degraded frequency response. These discontinuities are encountered by either the high frequency or mid frequency wavefront when propagated in the absence of the other wavefront and the frequency of the interference is dependant on the dimensions of the sound chamber exits.

In the preferred embodiment, the discontinuities of the passageways of both frequency bands are so sized that the interference occurs in a frequency range in which both high frequency and mid frequency drivers are capable of full acoustic output. The solution to the interference is found in time alignment of the mid frequency and high frequency wavefronts and the overlap in the frequency domain of the two frequency bands of sound. The result of this is that a transducer operating at a frequency where destructive interference will occur when the driver operates in the absence of the other frequency band does not encounter any interference when both drivers are operated simultaneously. This is so because the exits of both the mid frequency and high frequency sound chambers and thus the entire entrance of the waveguide is acoustically energized in the frequency range of concern.

An object of the present invention is to provide a method to create at least two wavefronts of at least two frequency ranges within a loudspeaker enclosure which will merge within the loudspeaker enclosure to form a single wavefront with virtual zero interference that includes all the acoustical energy of both wavefronts and both frequency ranges.

It is a further object of the present invention to provide a method to allow at least two wavefronts of a common frequency range and at least two wavefronts of a another common frequency range to produce a common wavefront within the same loudspeaker enclosure.

It is a further object of the present invention to provide a method to create one or more wavefronts within one or more loudspeaker enclosures that will merge with the wavefront (s) of the same frequency range in an adjacent similar loudspeaker enclosure with virtually zero interference.

It is a further object of the present invention to provide the optimal transformation of the shape of a sound wave between the exit of a mid range compression driver and the entrance of the associated waveguide by means of particular sound chambers.

It is a further object of the present invention to provide a method to eliminate interference between two wavefronts of different frequency ranges at the point of summation at the exit of particular sound chambers and the entrance of the associated waveguides by the application of particular geometric shapes, time delay and particular filtering of the sound signal in the electronic domain.

DESCRIPTION OF THE PREFERRED EMBODIMENT

Figure 1A:
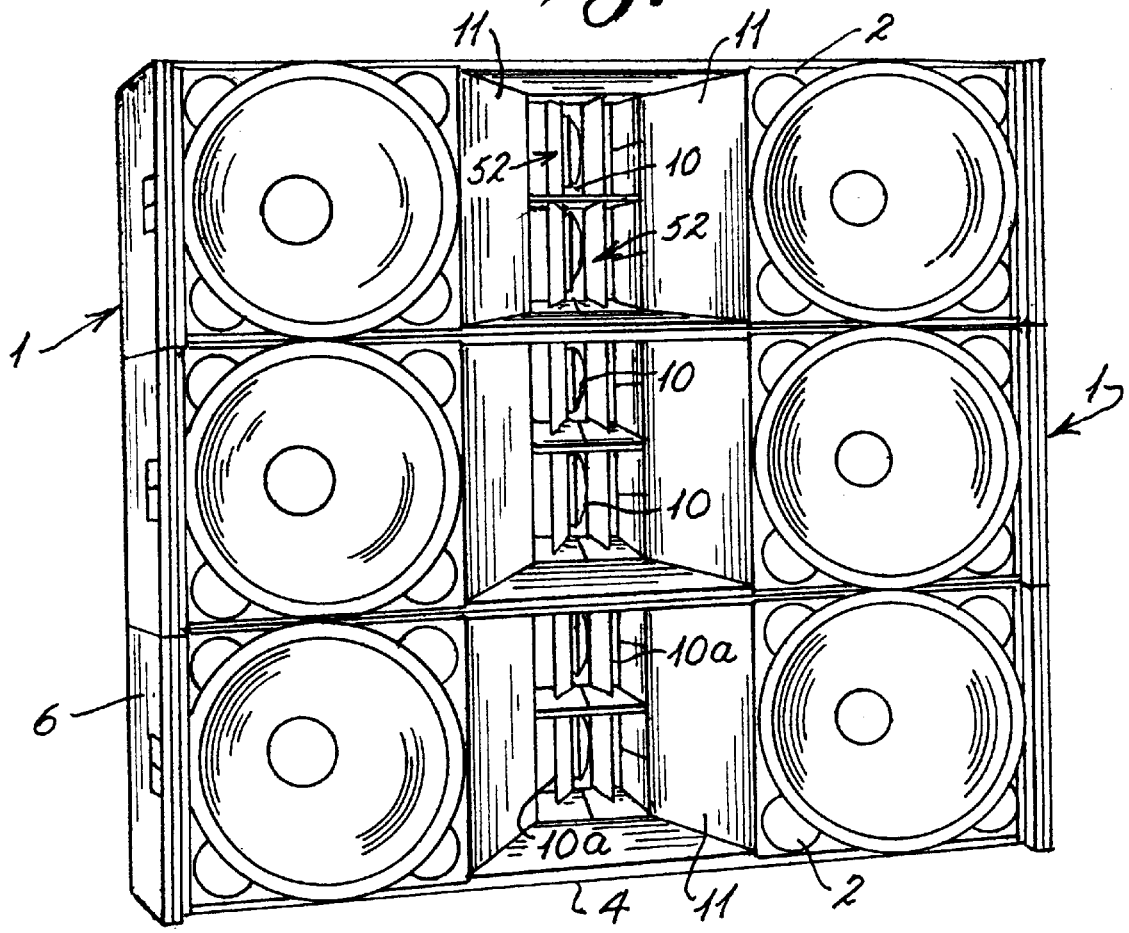
FIG. 1A is a frontal view of several loudspeaker enclosures showing high and mid frequency exits and waveguide of the present invention.
Figure 1B:
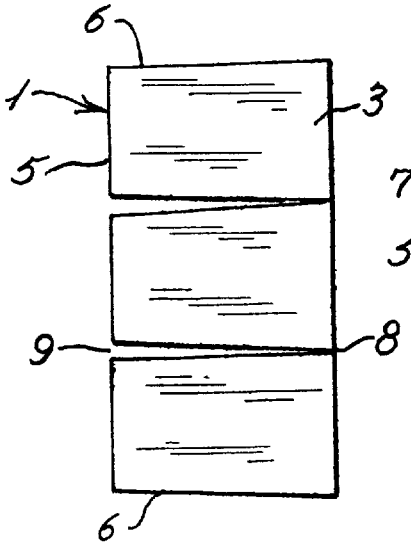
FIG. 1B shows a first alternative arrangement of the loudspeaker enclosures shown in FIG. 1A.
Figure 1C:
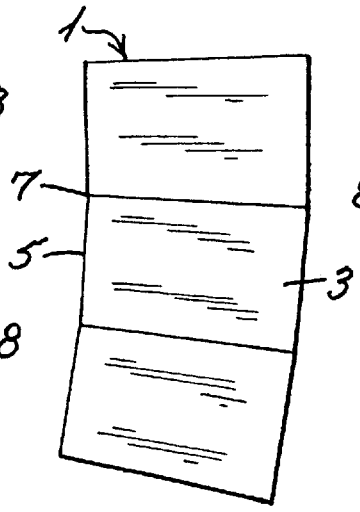
FIG. 1C shows a second alternative arrangement of enclosures for loudspeakers as shown in FIG. 1A.
Figure 1D:
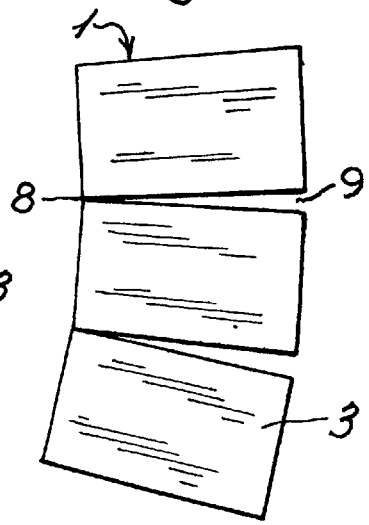
FIG. 1D shows a further alternate arrangement of loudspeaker enclosures similar to that shown in FIG. 1A.

The present invention as shown FIGS. 1 A, B, C, and D includes enclosures 1 that are trapezoidal in the vertical cross section, having front walls 2, top walls 3, bottom walls 4, rear walls 5 and side walls 6. When placed in use the top and bottom surfaces of the enclosures may be placed as shown in FIG. 1C as nearly to being co-planar 7 as practicable or may be placed as shown in FIGS. 1B and D so that the front or rear edge of the enclosures are touching one another 8 and the opposite edge is spaced 9 a predetermined distance from the adjacent enclosure. In this manner, it is possible to create arrays of enclosures with a wide variety of curvatures.

In the present invention a plurality of high frequency sound chamber exits 10 are arrayed contiguously at the entrance to a waveguide 11 permitting the formation of a nearly continuous ribbon of high frequency acoustical energy which does not suffer from acoustical interference between the individual elements in the array. Further a plurality of mid frequency sound chamber exits or output orifices 10*a* are arrayed in two contiguous parallel rows spaced equidistant from the high frequency exits or output orifices 10. The result is a single common wavefront that spans both the mid frequency and high frequency ranges and emanates from a plurality of enclosures which will be described in greater detail hereinafter.

Figure 2:
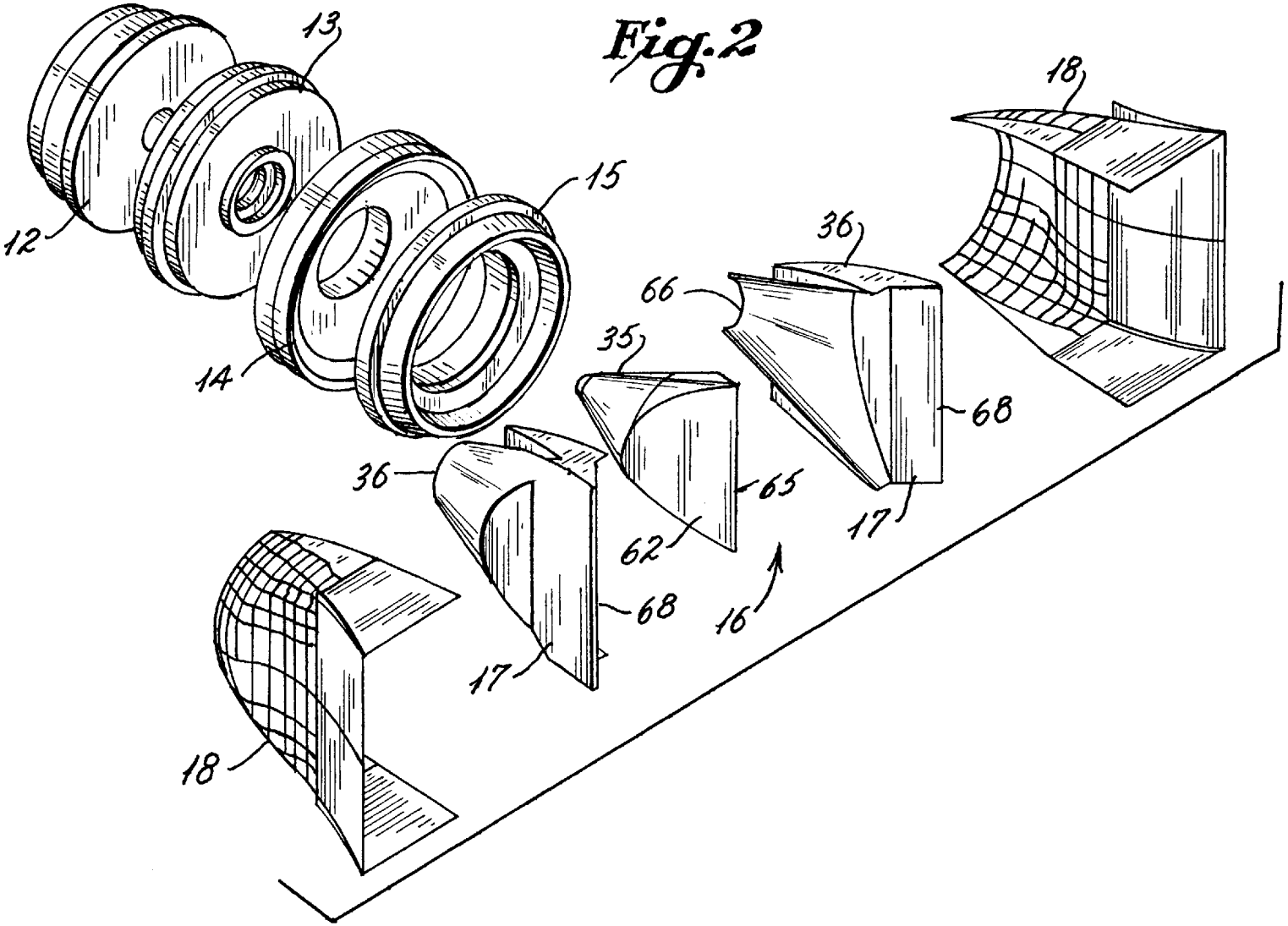
FIG. 2 is an exploded view showing drivers, sound chambers and waveguide of the invention.
Figure 7:
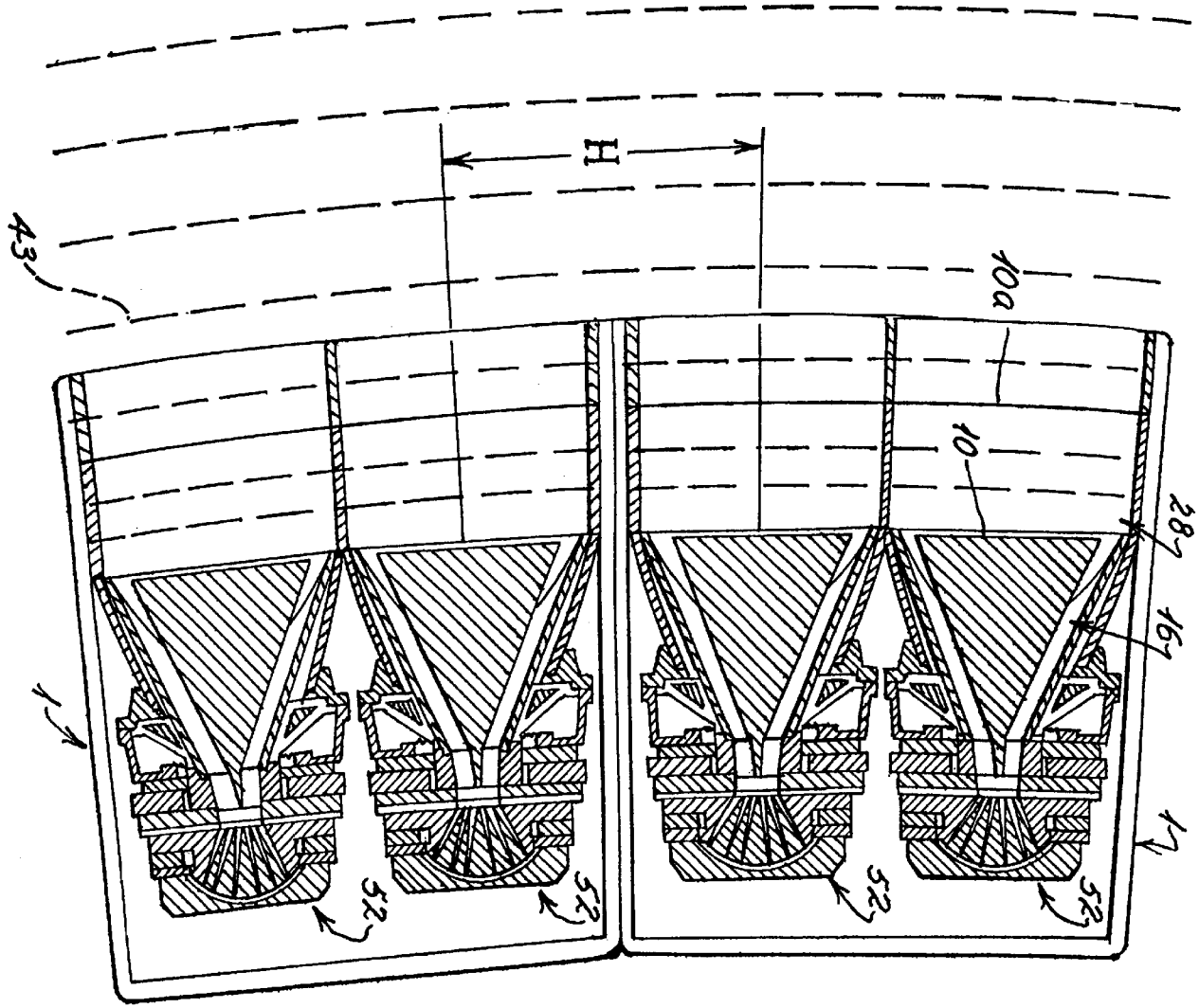
FIG. 7 is a loudspeaker enclosure array according to the invention.
Figure 8:
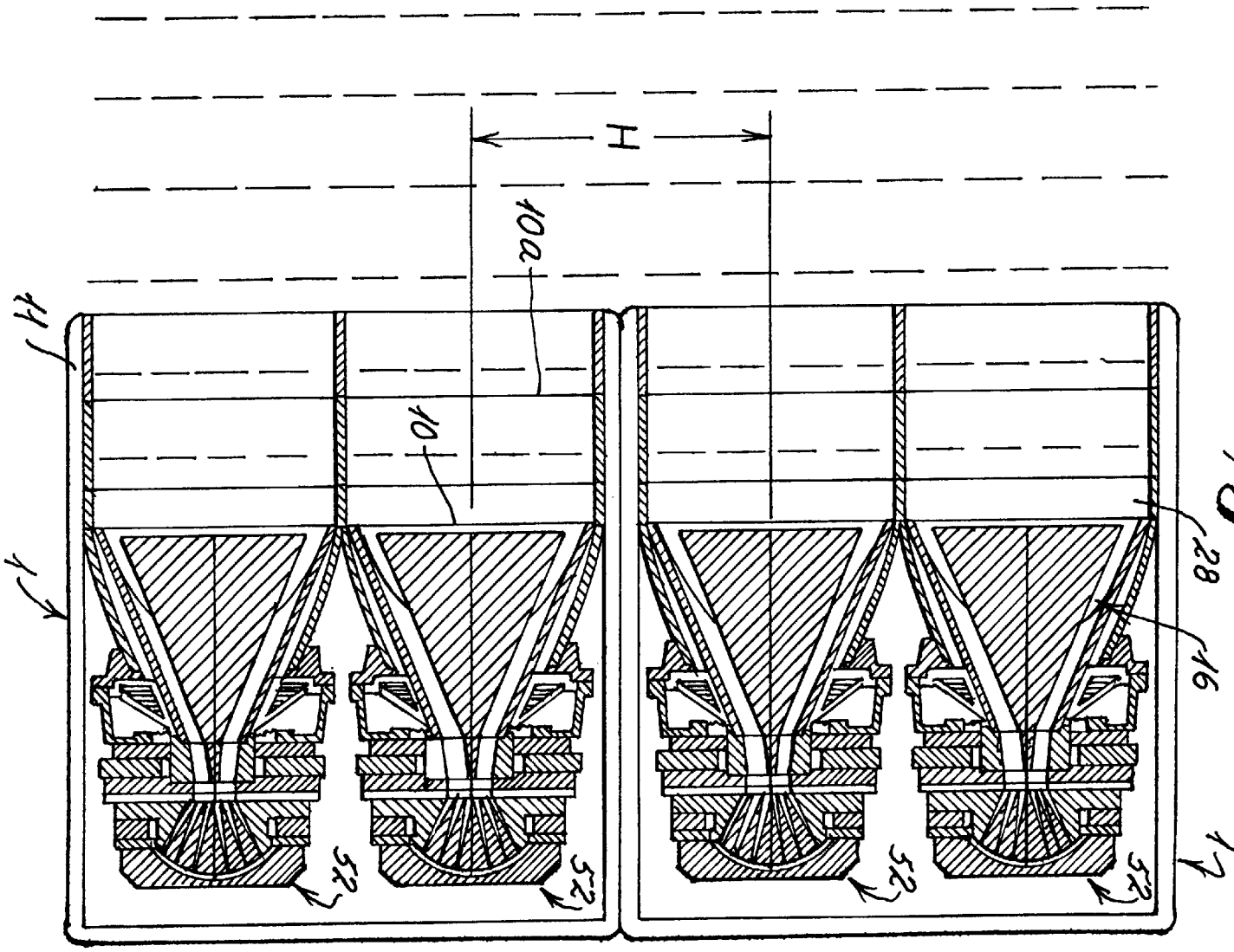
FIG. 8 is another loudspeaker enclosure array according to the invention.

FIG. 2 shows an exploded view of the principal parts of the invention in its present embodiment. This figure shows a single set of acoustical transducers or driver units 52 and their associated mid and high frequency sound chambers and waveguide. In the preferred embodiment there are two sets of acoustical transducers and their associated sound chambers and waveguides in each enclosure, such as shown in FIGS. 7 and 8.

Each drive unit includes a high frequency compression driver 12, a mid frequency magnet assembly 13, a mid frequency thin metallic diaphragm assembly 14, a mid frequency phase plug assembly 15, an inner body 35 of a high frequency inner sound chamber 16 which is mounted between outer shell halves 17 of the high frequency inner sound chamber, and mid frequency outer sound chamber shell halves 18. Such typical high frequency compression drivers have a lower frequency operating limit between 500 Hz and 1200 Hz and an upper frequency limit of approximately 20,000 Hz. In the preferred embodiment the high frequency compression driver is a JBL Model 2451.

In the preferred embodiment the inner body 35 of the high frequency sound chamber 16 is shaped as an elliptical cone that has two approximately planar facets 62 cut from each side shaped so that the two facets extend from the mid point along the side of the cone and meet at the center of the large end of the ellipse forming a sharp edge 65 that extends to the full width of the large end of the ellipse. The outer shell 17 is so shaped that its inner surface and the outer surface of the inner body form a circular input orifice 66 and a rectangular output orifice 68 connected by a passageway of approximately constant width. The possible pathways that may be traversed by the sound wave are so sized by the geometry of the inner body and outer shell that the wavefront that emerges from the rectangular output orifice is nearly planar with a small curvature in the frontal plane. Such an arrangement is shown in U.S. Pat. No. 5,900,593 to Adamson, the contents of which are incorporated herein by reference.

Figure 3:
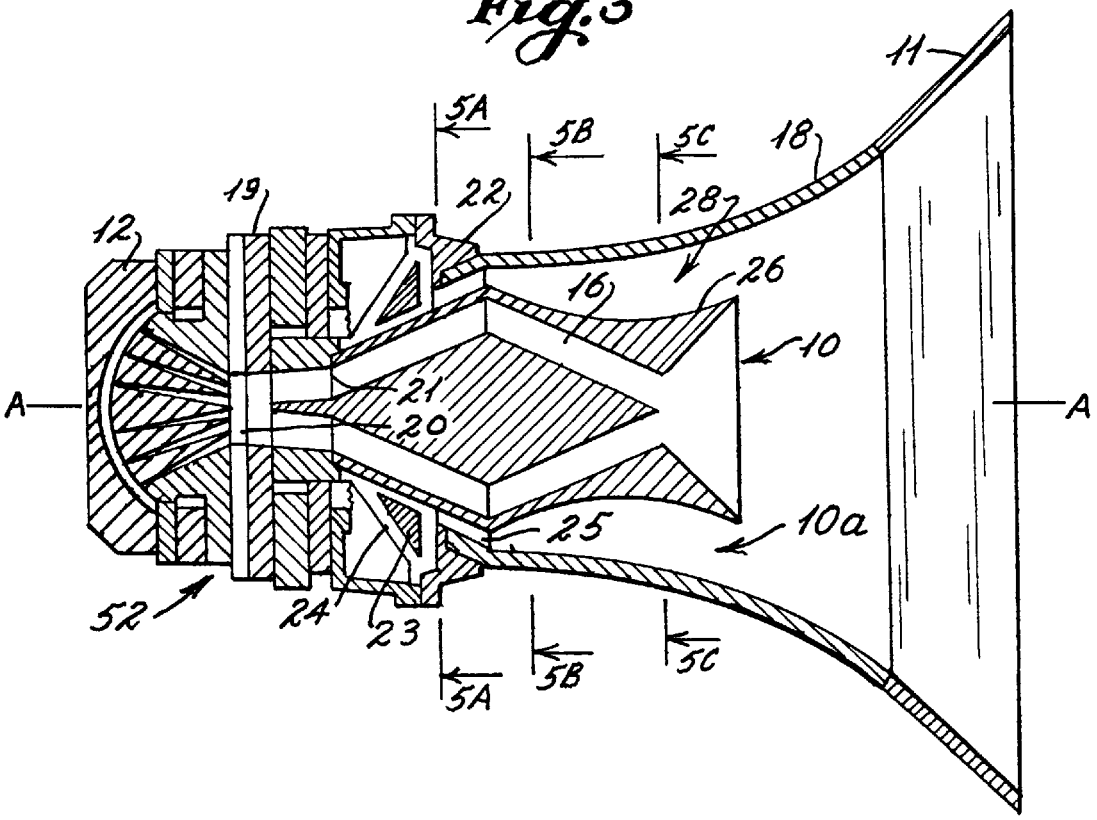
FIG. 3 is a cross sectional view showing a placement of an inner sound chamber within an outer sound chamber.
Figure 4:
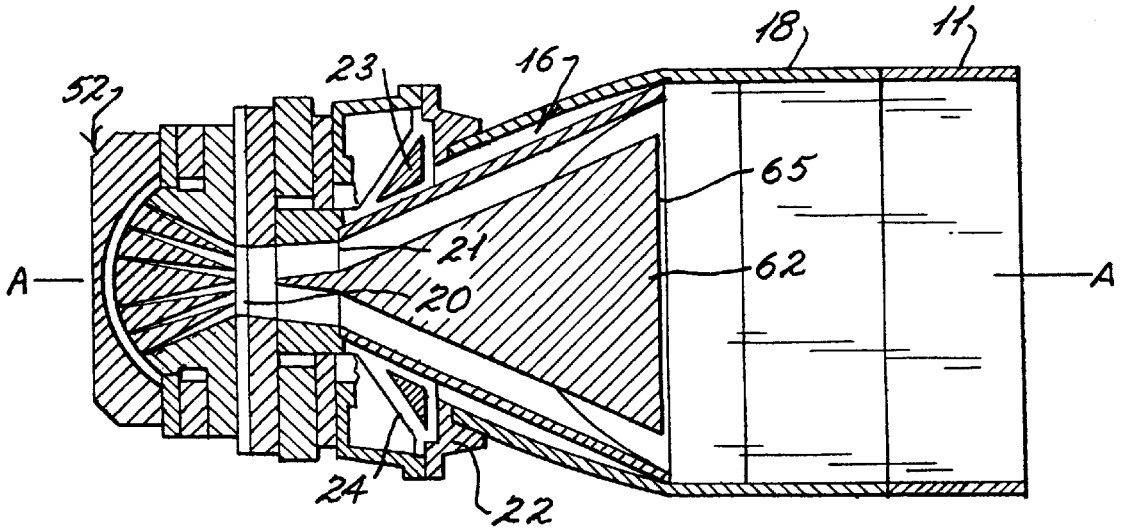
FIG. 4 is a cross sectional view similar to FIG. 3 but taken 90° with respect thereto.

FIG. 3 shows a cross section, side view and FIG. 4 shows a cross section, plan view of a single set of acoustical transducers and their associated sound chambers and waveguide. The mid frequency magnet 19 is constructed with an opening at its center 20 to allow the passage of high frequency sound waves through the mid frequency magnet and into entrance 21 of the high frequency sound chamber 16. The mid frequency phase plug body 22 and the phase plug ring 23 are so constructed to guide the mid frequency sound wave generated by the mid frequency diaphragm 24 into the entrance or input orifice 25 of the mid frequency sound chamber 28 without acoustical interference caused by reflecting sound waves. The outer surface 26 of the high frequency sound chamber 16 is shaped to provide a smooth passageway for the transmission of the mid frequency sound waves in the mid frequency sound chamber 28 defined between shell halves 18. The outside of the high frequency sound chamber is further modified to cause the mid frequency sound wave to be modified from an annular shape at entrance or input orifice 25 to a dual rectangular shape at exit or output orifice 10*a*. Both the high and mid frequency sound waves are further controlled by the waveguide 11 which is placed at the exit of the sound chambers. It should be noted that a center of the input orifice 25 and a center of the output orifice 10*a* of the mid frequency sound chamber are aligned along a primary axis A—A of the sound chamber.

Figures 5A, 5B, 5C:
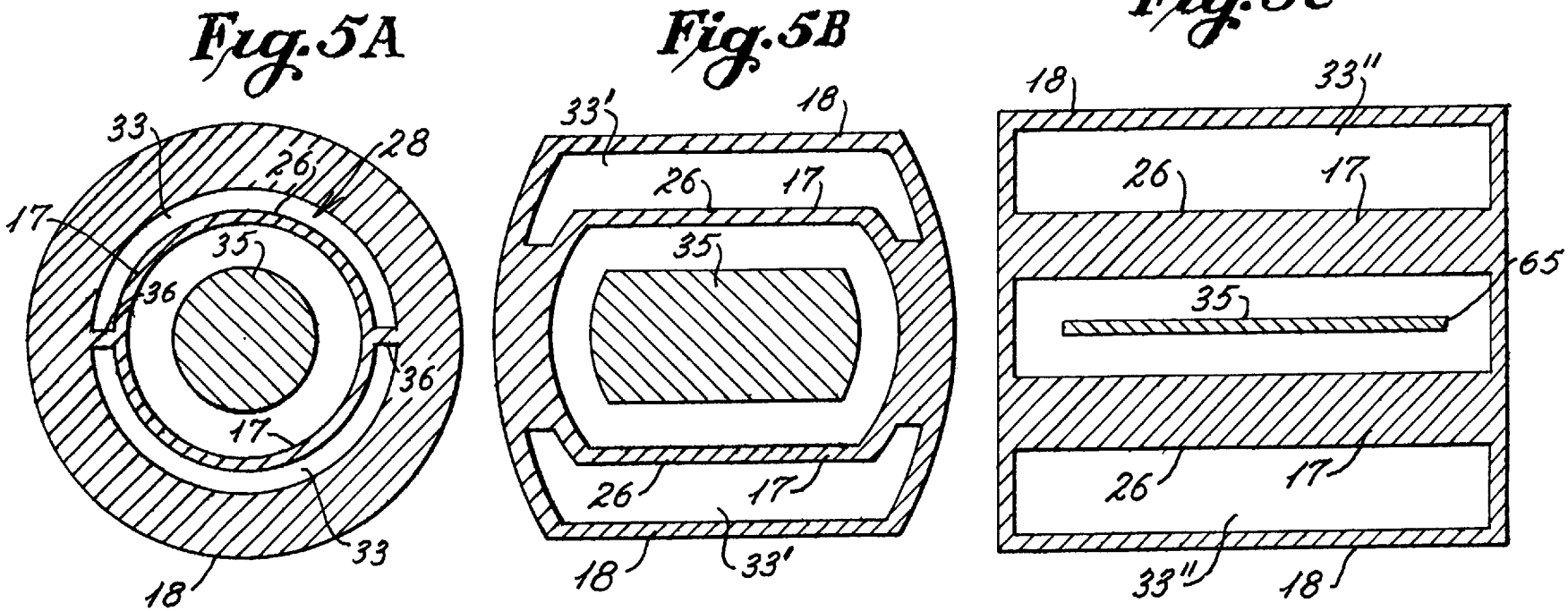
FIG. 5A is a cross sectional view taken along line 5A—5A of FIG. 3 showing a concentric relationship of the mid frequency sound chamber relative to the high frequency sound chamber at the entrances thereof.
FIG. 5B is a cross sectional view taken along line 5B—5B of FIG. 3 at the approximate mid section of the high frequency sound chamber.
FIG. 5C is a cross sectional view taken along line 5C—5C of FIG. 3 taken adjacent the exit end of the high frequency sound chamber.

FIGS. 5A–5C are sections of the inner and outer sound chambers which show changing shape of the mid and high frequency chambers which dictates the shape of the mid frequency wavefront. FIG. 5A shows the mid frequency sound chamber 28 is generally annular in configuration at the entrance 25 so that a wavefront is generally annular at the entrance. The annular wavefront is divided into two separate passageways 33 by wedge shaped protrusions 36 on the outside surface 26 of the inner or high frequency sound chamber 16. This feature 36 can be observed in FIG. 5A. The configuration of the mid frequency sound chamber 28 changes along its length and in FIG. 5D parallel channels or passageways 33' are created so that the mid frequency wavefront is further changed. This is accomplished by increasing the width of the wedge shaped protrusion 36. FIG. 5C shows the final transformation of the mid frequency sound chambers at the exit end 10 of the high frequency sound chamber 16 which functions to form the wavefront into two parallel rectangular wavefronts in passageways 33" spaced equidistant from a high frequency wavefront exiting from the exit end of the high frequency sound chamber.

Figure 6A:
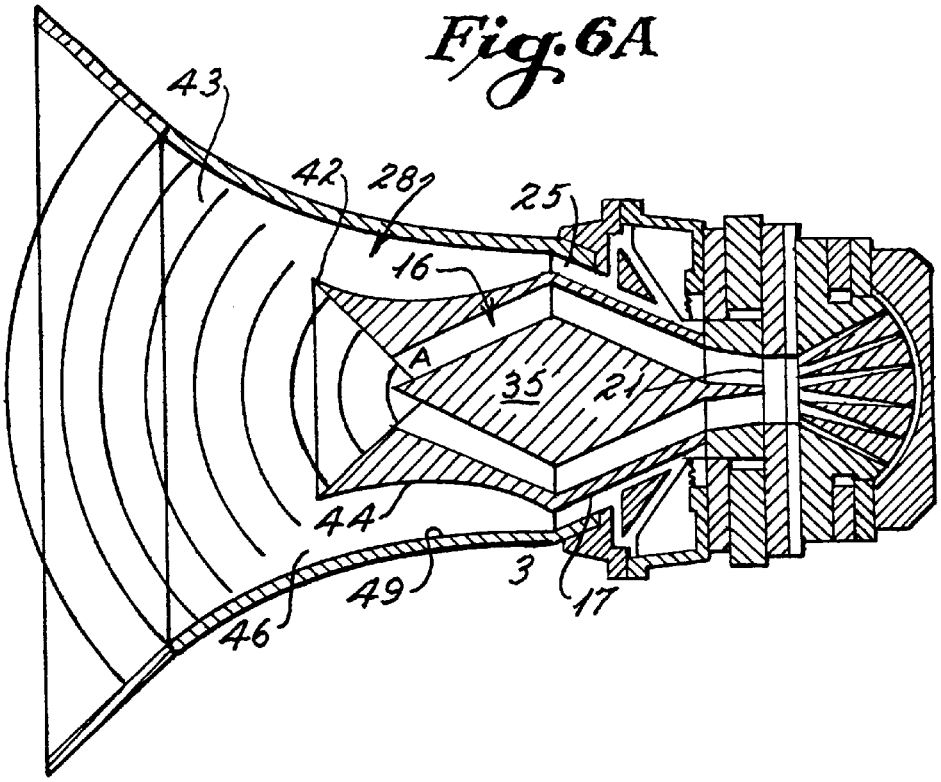
FIG. 6A is a view similar to FIG. 3 illustrating the relationship of mid and high frequency wavefronts in accordance with the invention.

FIG. 6A shows a cross section of the high and mid frequency drivers and the inner and outer sound chambers 16 and 28, respectively. The outer shell 17 of the inner high frequency sound chamber 16 is extended at 42 to guide the sound wave 43 at the desired angle A and to further provide acoustic loading to the high frequency compression driver. The outer shell is further modified to provide a smooth outer concave curve surface 44 which, combined with the inner surface 49 of the outer mid frequency sound chamber, provides a smooth passageway at 46 for the propagation of the mid frequency sound wave.

Figure 6B:
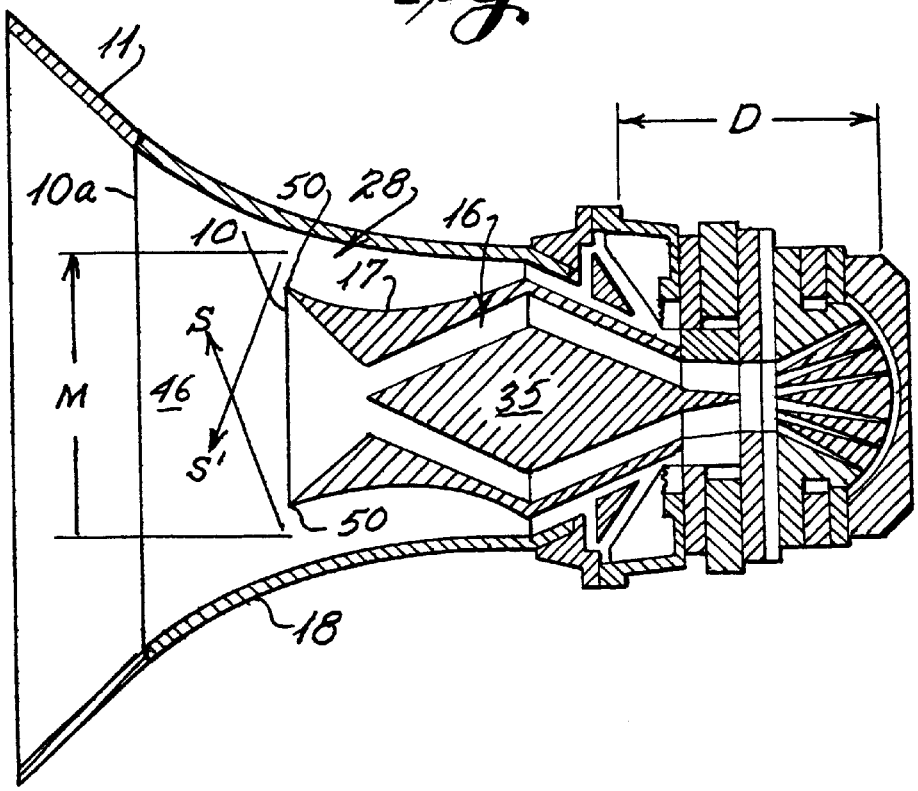
FIG. 6B is a view similar to FIG. 6A illustrating interference solutions with respect to the mid and high frequency wavefronts of the invention.

As shown in FIG. 6B, the correct summation of the mid frequency and the high frequency wavefronts requires that both wavefronts arrive at the point of summation at the entrance to the waveguide 11 at the same time. Since the sound generating diaphragm of the high frequency and mid frequency drivers are separated by a distance D, it is necessary to introduce a time delay into the signal path of the high frequency driver equal to D divided by the speed of sound in air. This method is common in prior art for systems of all types. In this manner, both wavefronts arrive at the same time and do not create destructive interference in the entrance of the waveguide.

When any sound wave exits any aperture where the aperture is smaller than the wavelength, diffraction, which can be described as a sudden change in the direction of the wavefront, will occur. When a sound wave of a frequency equal to two times the distance M exits from the two spaced points of exit of the two parallel mid frequency channels 33" of the outer sound chamber 28 as shown in FIG. 5C, the sound originating at either exit diffracts at the sudden discontinuity 50 and moves in the direction S or S' toward the other exit. Because the wavelength is two times the distance M, the sound arrives at the other exit 180 degrees out of phase with the sound exiting therefrom. This results in a sharp reduction in acoustic output at that frequency. This first cancellation frequency shows as a sharp notch in the frequency response of the device when operated in the absence of the high frequency driver. At higher frequencies, the phenomenon is not as apparent, but results in a degradation of the performance of the mid frequency device as measured in the frequency domain.

The mid frequency solution to this problem is found in limiting the physical dimension M and therefore the frequency derived therefrom to that which can also be produced by the high frequency driver. When the high frequency exit 10 is energized with the same frequency sound wave, in phase with the sound at the mid frequency exits 10*a*, no diffraction can occur because the entire waveguide is energized.

In FIG. 6A the high frequency sound waves 43 exiting the inner sound chamber encounter interference from the open cavity 46 represented by the outer sound chamber exit. This interference results in uneven amplitude and overall reduced acoustical output in the lower end of the operating spectrum of the high frequency driver.

The solution at this problem is found in extending the high frequency sound chamber 16 to provide acceptable high frequency response to at least the upper frequency of operation of the mid frequency driver and energizing the two outer sound chamber exits 10*a* with the same frequency sound wave, in phase with the sound at the high frequency exits 10. The upper frequency limit of the mid frequency driver in the preferred embodiment is more than 1.5 octaves above the first occurrence of mid frequency acoustic cancellation. Since the high frequency driver can operate from below the cancellation frequency and the mid frequency driver can operate well above the high frequency interference, the entire range of problem frequencies is corrected.

In the preferred embodiment the high frequency driver is capable of operating to a low frequency limit of 1,000 Hz. The mid frequency dimension M is 5" which is half the wavelength at 1,350 Hz. By setting the operating band of the high frequency driver from 1,200 Hz to 20,000 Hz the high frequency driver energizes the entrance to the waveguide in the frequency range where the mid frequency wavefront exhibits diffraction. Thus the mid frequency problem is solved.

In the preferred embodiment the mid frequency driver is capable of full output to an upper frequency limit of 3,000 Hz. The high frequency sound chamber extension is approximately 4" wide and provides good high frequency performance to a lower limit of 3,000 Hz. However, the mid frequency sound chamber exits prove to interfere with high frequency performance below 3,000 Hz. By extending the operating bandwidth of the mid frequency driver to an upper limit of 3,000 Hz, the mid frequency exits are energized in the frequency range where the high frequency performance exhibits reflections and uneven performance. When such energization of said exits takes place the interference is eliminated.

The relationship between the high frequency sound chamber and the mid frequency sound chamber is clearly a symbiotic relationship. Each waveform requires the other in order to exit cleanly from the sound chambers and to enter into the throat of the waveguide.

FIG. 7 shows a side view cross section of two speaker enclosures 1, each enclosure containing two driver units 52 placed in an ideal curved array. The curvature of the high frequency wavefront as described in U.S. Pat. No. 5,900,593, to Adamson, is proportional to the high frequency exits as controlled through the geometry of the inner high frequency sound chamber 16. Provided that the distance "H" between centers of the mid frequency exits 10*a* is less than one wavelength of the frequency propagated, the mid frequency exits will be mutually coupled. The resultant curvature of the mid frequency wavefront 43 will be proportional to the curvature of the array.

FIG. 8 shows a side view cross section of two speaker enclosures 1, each enclosure containing two driver units 52 placed in an ideal flat array according to U.S. Pat. No. 5,163,167 to Heil, the contents of which are also incorporated herein by reference. The planar shape of the high frequency exits will result in cylindrical wavefronts 56 as described in Heil shaped through the geometry of the inner high frequency sound chamber 16. Provided that the distance between centers of the mid frequency exit H is less than one wavelength of the frequency propagated, the mid frequency exits will be mutually coupled. The resultant mid frequency wavefront will similarly cylindrical.

What is claimed is:

1. An acoustical transducer and sound chamber assembly including an acoustical driver unit having a high frequency driver and a mid frequency driver assembly, said high frequency driver having an output oriented along a primary axis, said mid frequency driver assembly having a generally annular output surrounding said primary axis, a sound chamber assembly including a high frequency inner sound chamber including an outer shell generally aligned about said primary axis and having inner and outer surfaces, said outer shell of said high frequency inner sound chamber including an input entrance aligned with said output of said high frequency driver and an output orifice, an inner body mounted within said outer shell of said high frequency inner sound chamber, a mid frequency outer sound chamber defined between said outer shell of said high frequency inner sound chamber and an outer shell of said mid frequency outer sound chamber, said mid frequency sound chamber having a generally annular input orifice aligned with said output of said mid frequency driver assembly, a pair of spaced output orifices disposed on opposite sides of said primary axis and being substantially in the shape of two rectangular slots, and said mid frequency outer sound chamber defining an acoustic passageway connecting said generally annular input orifice to said spaced output orifices.

2. The acoustical transducer and sound chamber assembly of claim 1 wherein said spaced output orifices of said mid frequency outer sound chamber are substantially parallel to and spaced equidistant from and on opposite sides of said output orifice of said high frequency inner sound chamber.

3. The acoustical transducer and sound chamber assembly of claim 1 wherein said mid frequency driver assembly includes a mid frequency magnet assembly, a mid frequency diaphragm assembly and a mid frequency phase plug assembly, and said mid frequency magnet assembly including a central opening allowing passage of high frequency sound waves from said high frequency driver to said input entrance of said high frequency inner sound chamber.

4. The acoustical transducer and sound chamber of claim 1 in which said inner surface of said outer shell of said high frequency inner sound chamber and an outer surface of said inner body are so configured so as to define said high frequency inner sound chamber with a generally circular input entrance and a generally rectangular output orifice.

5. The acoustical transducer and sound chamber assembly of claim 4 in which possible sound passageways between said input entrance of said high frequency inner sound chamber and said output orifice thereof are such that any wave front emerging from the output orifice is substantially planar having only minor curvature in a frontal plane of projection movement of the sound wave.

6. The acoustical transducer and sound chamber assembly of claim 1 in which said outer surface of said outer shell of said high frequency inner sound chamber includes a concavely curved portion extending from said output orifice toward a central portion of said outer shell toward said input entrance, and said outer shell of said mid frequency outer sound chamber including an inner surface which is somewhat convexly configured and spaced from said concavely curved portion of said outer shell of said high frequency inner sound chamber.

7. The acoustical transducer and sound chamber assembly of claim 1 in which said outer shell of said high frequency inner chamber and said outer shell of said mid frequency outer sound chamber and said inner body of said high frequency chamber are so configured with respect to one another so as to cause a mid frequency sound wave from said mid frequency driver assembly to be propagated co-axially with a high frequency sound wave from said high frequency driver and to be propagated at said spaced output orifices thereof co-linearly with a high frequency sound wave propagated from said output orifice of said high frequency inner sound chamber.

8. The acoustical transducer and sound chamber assembly of claim 1 including a wave guide mounted to said outer shell of said mid frequency outer sound chamber for receiving sound waves propagating therefrom.

9. A loudspeaker assembly including an enclosure, at least one acoustical transducer and sound chamber assembly mounted within said enclosure, said at least one acoustical transducer and sound chamber assembly including an acoustical driver unit having a high frequency driver and a mid frequency driver assembly, said high frequency driver having an output oriented along a primary axis, said mid frequency driver assembly having a generally annular output surrounding said primary axis, a sound chamber assembly including a high frequency inner sound chamber including an outer shell generally aligned about said primary axis and having inner and outer surfaces, said outer shell of said high frequency inner sound chamber including an input entrance aligned with said output of said high frequency driver and an output orifice, an inner body mounted within said outer shell of said high frequency inner sound chamber, a mid frequency outer sound chamber defined between said outer shell of said high frequency inner sound chamber and an outer shell of said mid frequency outer sound chamber, said mid frequency outer sound chamber having a generally annular input orifice aligned with said output of said mid frequency driver assembly, a pair of spaced output orifices disposed on opposite sides of said primary axis and being substantially in the shape of two rectangular slots, and said mid frequency outer sound chamber defining an acoustic passageway connecting said generally annular input orifice to said spaced output orifices.

10. The loudspeaker assembly of claim 9 including two of said acoustical transducer and sound chamber assemblies mounted within said enclosure.

* * * * *